US011348705B2

(12) United States Patent
Costello et al.

(10) Patent No.: US 11,348,705 B2
(45) Date of Patent: May 31, 2022

(54) COAXIAL CABLE SYSTEM FOR GAS TURBINE ENGINE

(71) Applicant: Rolls-Royce Corporation, Indianapolis, IN (US)

(72) Inventors: John Joseph Costello, Indianapolis, IN (US); Robert C. Dalley, Waldron, IN (US)

(73) Assignee: ROLLS-ROYCE CORPORATION, Indianapolis, IN (US)

( * ) Notice: Subject to any disclaimer, the term of this patent is extended or adjusted under 35 U.S.C. 154(b) by 562 days.

(21) Appl. No.: 16/191,062

(22) Filed: Nov. 14, 2018

(65) Prior Publication Data

US 2020/0126689 A1 Apr. 23, 2020

Related U.S. Application Data

(60) Provisional application No. 62/748,076, filed on Oct. 19, 2018.

(51) Int. Cl.

| | |
|---|---|
| ***H01B 9/06*** | (2006.01) |
| ***H01B 7/29*** | (2006.01) |
| ***H01B 7/00*** | (2006.01) |
| ***H01B 7/02*** | (2006.01) |
| ***H01B 7/04*** | (2006.01) |

(Continued)

(52) U.S. Cl.

CPC ..... *H01B 7/292* (2013.01); *H01B 7/0063* (2013.01); *H01B 7/0241* (2013.01); *H01B 7/04* (2013.01); *H01B 13/067* (2013.01); *H01B 13/221* (2013.01); *H01B 13/228* (2013.01); *F05D 2220/32* (2013.01); *F05D 2230/20* (2013.01);

(Continued)

(58) Field of Classification Search

CPC .. H01B 9/0611; H01B 9/0616; H01B 9/0655; H01B 9/0688

See application file for complete search history.

(56) References Cited

U.S. PATENT DOCUMENTS 1,937,054 A 11/1933 Cremer et al.
3,013,912 A 12/1961 Priaroggia et al.

(Continued)

FOREIGN PATENT DOCUMENTS

EP 2 254 126 A1 11/2010
EP 2 581 916 A1 4/2013

(Continued)

OTHER PUBLICATIONS

Champion Aerospace Technical Spotlight, Characterization and Benefits of High and Low Tension (Voltage) Ignition System Designs, dated at least as early as Aug. 15, 2016, pp. 1-4, ECCN: 93991, Champion Aerospace LLC, Liberty, SC.

(Continued)

*Primary Examiner* — Chau N Nguyen
(74) *Attorney, Agent, or Firm* — Crowell & Moring LLP

(57) ABSTRACT

A coaxial cable system includes an electric conductor to conduct electric power in a gas turbine engine. The system also includes a dielectric tape helically wound to contiguously surround the electric conductor and a flexible conduit disposed to surround and contiguously contact the dielectric tape. A dielectric liquid may be impregnated within the dielectric tape, and a flexible protective cover may concentrically disposed to surround the flexible conduit.

18 Claims, 4 Drawing Sheets

(51) Int. Cl.
*H01B 13/06* (2006.01)
*H01B 13/22* (2006.01)

(52) U.S. Cl.
CPC ..... *F05D 2230/60* (2013.01); *F05D 2260/99* (2013.01); *F05D 2300/50* (2013.01)

(56) References Cited

U.S. PATENT DOCUMENTS

| | | | | | |
|---|---|---|---|---|---|
| 4,282,284 | A | | 8/1981 | George | |
| 4,782,194 | A | * | 11/1988 | Johnsen | H01B 7/226 174/106 R |
| 5,569,876 | A | * | 10/1996 | Podgorski | H01B 7/0233 174/137 R |
| 5,654,526 | A | * | 8/1997 | Sharp | H02G 3/06 174/84 R |
| 5,941,698 | A | * | 8/1999 | Darling | F23D 14/24 431/9 |
| 6,483,022 | B1 | | 11/2002 | Packard | |
| 7,124,724 | B2 | | 10/2006 | Fleetwood | |
| 7,622,677 | B2 | | 11/2009 | Barberree et al. | |
| 8,766,095 | B2 | | 7/2014 | Kenworthy et al. | |
| 9,287,646 | B2 | * | 3/2016 | Mark | H02J 7/0042 |
| 9,935,434 | B2 | * | 4/2018 | Soerensen | H02G 3/03 |
| 2002/0162674 | A1 | * | 11/2002 | Bertini | H01B 7/2813 174/47 |
| 2010/0206604 | A1 | * | 8/2010 | Rocks | H01B 17/28 174/73.1 |
| 2013/0335908 | A1 | * | 12/2013 | Chiang | H01R 13/6598 361/679.31 |
| 2017/0144558 | A1 | * | 5/2017 | Remisch | H01R 13/005 |
| 2019/0237218 | A1 | * | 8/2019 | Heyne | B60L 53/18 |

FOREIGN PATENT DOCUMENTS

| | | | |
|---|---|---|---|
| GB | 313928 | * | 9/1930 |
| GB | 748678 | * | 5/1956 |
| GB | 928022 | | 6/1963 |

OTHER PUBLICATIONS

Champion Aerospace Data Sheet, IAE V2500 Ignition System Components, dated at least as early as Jan. 2017, pp. 1-2, Champion Aerospace LLC, Liberty, SC.

Champion Aerospace Data Sheet, CFM56/CF6 Ignition System, dated at least as early as Jan. 2017, pp. 1-2, Champion Aerospace LLC, Liberty, SC.

"Krytox™ Fluorinated Oils Help Solve Challenging Lubrication Problems," dated at least as early as Jun. 29, 2018, pp. 1-2, Krytox™ Lubricants, The Chemours Company, obtained at URL: https://www.chemours.com/Lubricants/en_US/products/Products_Oils.html.

"Extreme High Temperature Heat Flame Resistant Slit and Woven Ceramic Fiber Tape," dated at least as early as Jun. 29, 2018, pp. 1, Extreme Heat Protection™ from A-B Thermal Technologies, obtained at URL: http://www.extremeheatprotection.com/extreme-high-temperature-heatf . . . .

"High Temperature Heat Flame Abrasion Resistant Vermiculite Coated Fiberglass Woven Tape," dated at least as early as Jun. 29, 2018, pp. 1, Extreme Heat Protection™ from A-B Thermal Technologies, obtained at URL: http://www.extremeheatprotection.com/high-temperature-heat-flame-fire . . . .

Extended European Search Report, dated Mar. 19, 2020, pp. 1-7, issued in European Patent Application No. 19198372.5, European Patent Office, The Hague, The Netherlands.

* cited by examiner

COAXIAL CABLE SYSTEM FOR GAS TURBINE ENGINE

This application claims priority under 35 USC § 119(e) to U.S. provisional application 62/748,076, entitled "COAXIAL CABLE SYSTEM FOR GAS TURBINE ENGINE" filed Oct. 19, 2018, which is incorporated herein by reference in its entirety.

TECHNICAL FIELD

This disclosure relates to gas turbine engines and more particularly to a coaxial cable system for gas turbine engines.

BACKGROUND

Gas turbine engines may include a compressor, a combustor and a turbine. Typically, the compressor is an air compressor rotating on a shaft of the engine to provide air for the combustion cycle. Combustion occurs within the combustor by mixing air from the compressor with fuel provided by fuel injectors. When a gas turbine engine first starts, the fuel air mixture is ignited by ignitors. The ignitors may include a controller that provides timing of an electric arc to ignite the air fuel mixture. The electric arc may be generated from a source of electric power, such as a generator, a battery, a capacitor or the like.

BRIEF DESCRIPTION OF THE DRAWINGS

The embodiments may be better understood with reference to the following drawings and description. The components in the figures are not necessarily to scale.

DETAILED DESCRIPTION

A coaxial cable system may be included in a gas turbine engine that includes a combustor having an ignitor. The coaxial cable system may include an electric conductor electrically coupled with the ignitor. The electrical conductor may be helically wrapped with a dielectric tape and disposed in a flexible conduit for routing on the gas turbine engine. A dielectric fluid may be impregnated in capillaries included in and around the dielectric tape. The dielectric fluid may be maintained in the dielectric tape by an interior wall of the flexible conduit and end seals at a proximate end and a distal end of the flexible conduit. The interior wall and the end seals may be impervious to the dielectric fluid. The electric conductor and the dielectric tape may extend through the end seals so that the electrical conductor may be terminated in the gas turbine engine, such as at the ignitor and at a controller. The controller may be configured to activate the ignitor to generate an electric arc with a power impulse generated in the electric conductor. The coaxial cable system may also be used to supply power in other parts of the gas turbine engine.

An interesting feature of the systems and methods described may be that the dielectric tape and the dielectric liquid cooperatively operate to provide a light weight thermal and insulating barrier in high temperature environments such as in the vicinity of the combustor of the gas turbine engine.

Another interesting feature of the systems and methods described may be that the coaxial cable system may include inlet ports and outlet ports that allow injection of the dielectric liquid into a static assembly that includes the electric conductor, the helically wound dielectric tape and the flexible conduit. Injection of the dielectric liquid may occur prior to installation of the coaxial cable system on the gas turbine engine, or following routing and installation. Injection may be performed at a predetermined high pressure and temperature to impregnate the dielectric liquid into voids and other interstitial areas in and around the dielectric tape. Also, the input and output ports may be used to replace, replenish, test and/or monitor the dielectric liquid without removal of the coaxial cable system from the gas turbine engine.

Another interesting feature of the system and methods described may be that the coaxial cable system may be a closed system. Dielectric liquid in the system may be statically disposed to provide insulating and thermal barriers between the electric conductor and the flexible conduit.

Figure 1:
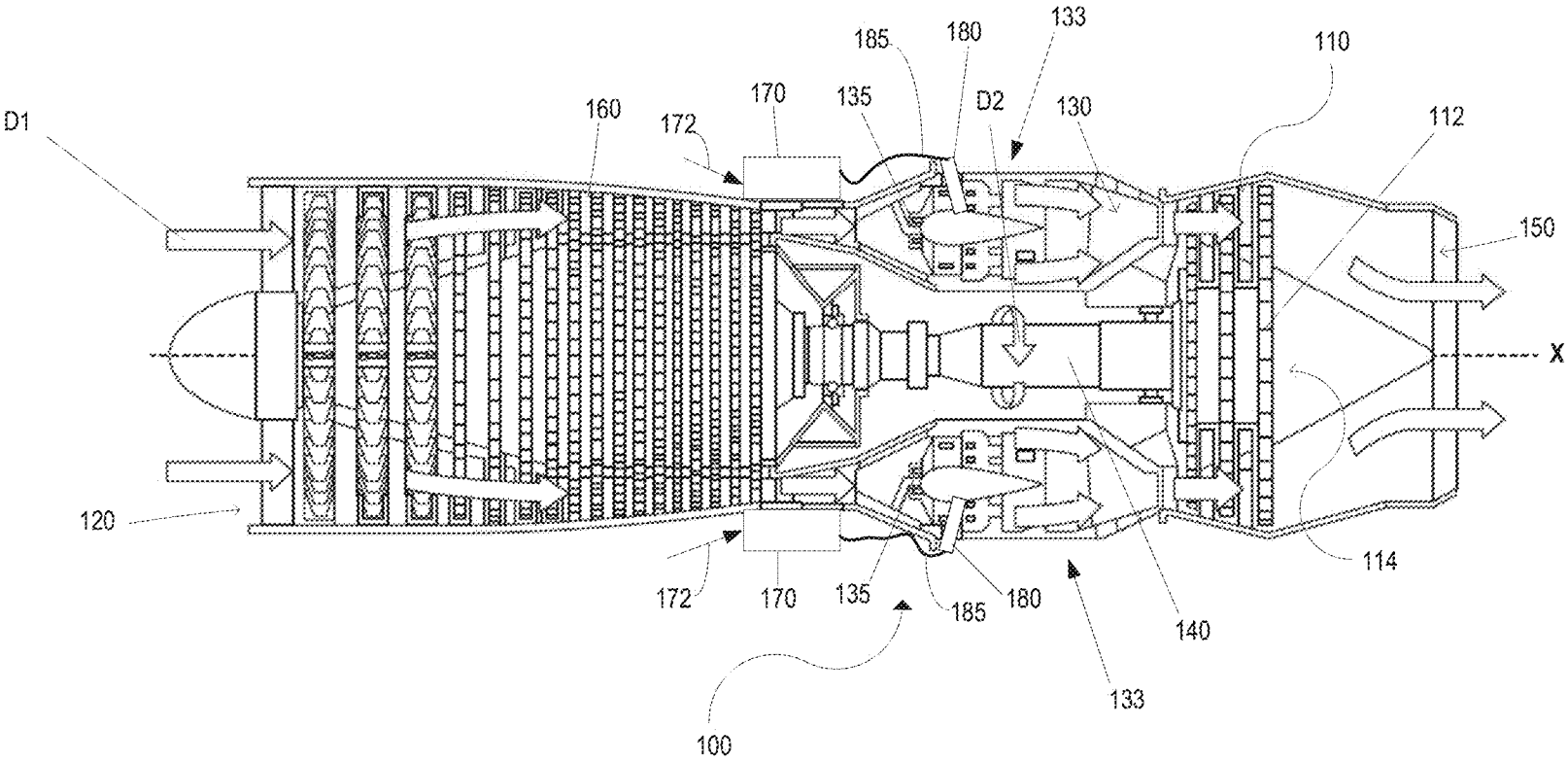
FIG. 1 illustrates a cross-sectional view of an example of a gas turbine engine that includes a coaxial cable system.

FIG. 1 is a cross-sectional view of an example of a gas turbine engine 100. In some examples, the gas turbine engine 100 may supply power to and/or provide propulsion of an aircraft. Examples of the aircraft may include a helicopter, an airplane, an unmanned space vehicle, a fixed wing vehicle, a variable wing vehicle, a rotary wing vehicle, an unmanned combat aerial vehicle, a tailless aircraft, a hover craft, and any other airborne and/or extraterrestrial (spacecraft) vehicle. Alternatively or in addition, the gas turbine engine 100 may be utilized in a configuration unrelated to an aircraft such as, for example, an industrial application, an energy application, a power plant, a pumping set, a marine application (for example, for naval propulsion), a weapon system, a security system, a perimeter defense or security system.

The gas turbine engine 100 may take a variety of forms in various embodiments. Though depicted as an axial flow engine, in some forms the gas turbine engine 100 may have multiple spools and/or may be a centrifugal or mixed centrifugal/axial flow engine. In some forms, the gas turbine engine 100 may be a turboprop, a turbofan, or a turboshaft engine. Furthermore, the gas turbine engine 100 may be an adaptive cycle and/or variable cycle engine. Other variations are also contemplated.

The gas turbine engine 100 may include an intake section 120, a compressor section 160, a combustion section 130, a turbine section 110, and an exhaust section 150. During operation of the gas turbine engine 100, fluid received from the intake section 120, such as air, travels along the direction D1 and may be compressed within the compressor section 160. The compressed fluid may then be mixed with fuel and the mixture may be burned in the combustion section 130. The combustion section 130 may include any suitable fuel injection and combustion mechanisms, such as a combustor 133 and a fuel nozzle 135. The hot, high pressure fluid may then pass through the turbine section 110 to extract energy from the fluid and cause a turbine shaft of a turbine 114 in the turbine section 110 to rotate, which in turn drives the compressor section 160. Discharge fluid may exit the exhaust section 150.

As noted above, the hot, high pressure fluid passes through the turbine section 110 during operation of the gas turbine engine 100. As the fluid flows through the turbine section 110, the fluid passes between adjacent blades 112 of the turbine 114 causing the turbine 114 to rotate. The rotating turbine 114 may turn a shaft 140 in a rotational direction D2, for example. The blades 112 may rotate around an axis of rotation, which may correspond to a centerline X of the turbine 114 in some examples.

The fuel air mixture in the combustor may be ignited by an ignitor controller 170. The ignitor controller 170 may be electrically coupled with an ignitor 180 by a coaxial cable system 185. The ignitors 180 is positioned adjacent the fuel nozzle 135 such that fuel emitted by the fuel nozzle 135 is ignited by an electrical ignition arc generated from the ignitor 180. During startup, a controller (not shown) included in the gas turbine engine 100 may instruct the ignitor controller 170 via a control line 172 to generate the ignition arc. The ignitor controller 170 may receive a power supply input 175, which is used to generate a high voltage pulse on the coaxial cable system 185.

The coaxial cable system 185 may be routed from the ignitor controller 170 to the ignitor 180 along the gas turbine 100. In the engine zone near the combustor 130, the coaxial cable system 185 may be subject temperatures in excess of 275 degrees Celsius. Polytetraflouroethylene (PTFE) insulation, which is a typical conductor insulation for power cables, is rated for operation up to about 504° F. (262° C.). At temperatures above this limit, the PTFE rating is exceeded and the cross-linked polymer bonds break and outgassing of the PTFE insulation begins to occur. If the temperature reaches about 330° C., the PTFE insulation will begin to reach its gel point and begin to melt. The coaxial cable system 185 may be used to address the high temperatures in the gas turbine engine zone near the combustor that are greater than 275° C. In other example applications, the coaxial cable system 185 may be used as a conductor of electric power for other systems within an aircraft or other vehicle using a gas turbine engine in which temperatures above 275° C. may be experienced. Such applications may include supplying electric power to electric motors, electric busses, and the like, in which the coaxial cable system 185 may be routed on or near the gas turbine engine 100.

Figure 2:
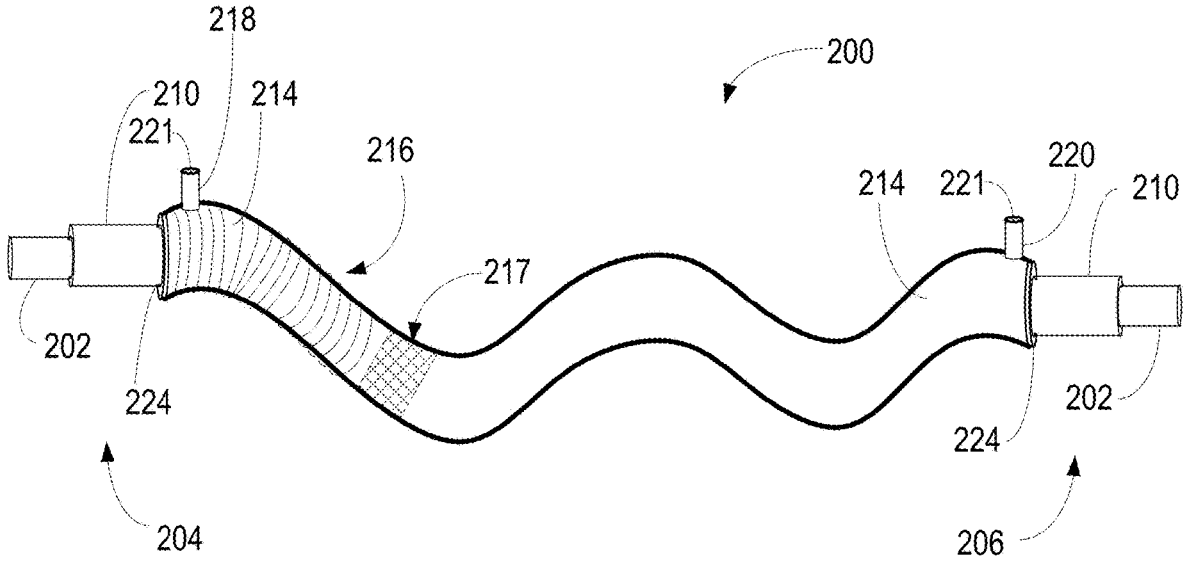
FIG. 2 is an example of a coaxial cable system.

FIG. 2 is an example of a coaxial cable system 200. In FIG. 2, the coaxial cable system 200 is for use in an gas turbine engine to conduct electric power similar to the coaxial cable system 185 discussed with reference to FIG. 1. Accordingly, for purposes of brevity the details of these features and functionality will not be repeated, however, it should be understood that such features and functionality are fully interchangeable, combinable, and/or useable in either the coaxial cable system 200 or the coaxial cable system 185, unless otherwise indicated. The coaxial cable system 200 includes an electric conductor 202 extending from a first end 204 (proximate end) and a second end 206 (distal end). The electric conductor 202 may be one or more flexible conductors of electric current and voltage, such as solid or stranded copper or aluminum wire. A spacer, such as at least one dielectric tape 210 may be helically wound to contiguously surround the electric conductor 202. The dielectric tape 210 may be a flexible planar insulating material, such as a fabric, fibers or other porous material formed with interstices. Example dielectric tapes include vermiculite coated fiberglass tape, fiberglass tape, ceramic tape, or some combination of these materials. The dielectric tape 210 may be a strip or band of flexible porous material capable of being helically wound around the electric conductor in an overlapped configuration to be contiguously aligned with the electric conductor 202.

The dielectric tape 210 may be high temperature heat resistant and thermally insulating, such as a dielectric tape having a continuous rating up to 1500 degrees Fahrenheit or 815 degrees Celsius. For example, the dielectric tape may be a fiberglass base fabric, which may be impregnated with vermiculite dispersant, resulting in a dielectric tape with higher continuous temperature capability and added abrasion resistance. In another example, a vermiculite coated sleeve and fiberglass materials may be used. Such configurations of dielectric tape may also protect copper or aluminum tubing (if present). The dielectric tape may provide thermal and electrical insulation, energy savings and personnel protection. In yet another example, the dielectric tape may be a ceramic tape with a continuous rating up to 2300 degrees Fahrenheit or 1260 degrees Celsius. The ceramic dielectric tape may be, for example, made from a combination of $SIO_2$ and $AL2O_3$ fibers. Similar to the other example configuration, this configuration may protect copper or aluminum tubing (if present) while also providing thermal and electrical insulation, energy savings and personnel protection. The ceramic dielectric tape may, for example melt above 3000 degrees Fahrenheit or 1648 degrees Celsius. The ceramic dielectric tape may also, for example, be an excellent replacement for asbestos materials.

The electric conductor 202 wrapped with the dielectric tape 210 may be contiguously disposed in a flexible conduit 214. The flexible conduit 214 may include a metal shield 216 that operates as a current conductor to provide a ground current path or neutral current path for current flowing in the electric conductor 202. In addition, the flexible conduit 214 may include a metal overbraid 217, such as a stainless steel overbraid to provide a flexible protective outer cover. The flexible conduit 214 may be a hermetically sealed and welded assembly, having a continuous inner wall that surrounds and contiguously contacts the dielectric tape 210. In some examples, the continuous inner wall is annular, and the dielectric tape 210 is contiguous with the inner wall to operate as a spacer and a strain relief to maintain the electric conductor 202 centrally positioned in the flexible conduit 214. The inner wall may be impervious to dielectric liquid. The flexible conduit 214 may be, for example, a corrugated structure for flexibility that includes an inner wall that is not smooth and includes a series of ribs or corrugations. Alternatively, the inner wall may be a smooth surface.

The coaxial cable system 200 may also include at least one inlet port 218 and at least one outlet port 220. The inlet port 218 may be at the first end 204, and the outlet port 220 may be at the second end 206. In other examples, any number of inlet ports 218 and exhaust ports 220 may be included in locations along the length of the coaxial cable system 200. The inlet port 218 may receive a dielectric liquid, such as a non-conducting oil. An example dielectric liquid is Krytox™ high performance oil. This example high performance oil has desirable physical properties, including insulating properties, and can operate from −75 to 399° C. The outlet port 220 may be opened to allow air and/or fluid to exit the flexible conduit 214. Accordingly, the dielectric liquid, may be dynamically injected into the inlet port 218, while at the same time fluid, such as air is being dynamically discharged from the outlet port 220. Thus, the inlet port 218 and the outlet port 220 may provide liquid communication between the dielectric tape and an external environment, outside the coaxial cable system 200.

Each of the inlet port 218 and the outlet port 220 may include a removable seal 221 operable as a barrier between the dielectric liquid and the external environment. In an example, the inlet and outlet ports 218 and 220 may be capped with a threaded removable cap providing a fluid-tight seal. In other examples, a fluid tight valve or other mechanism may be used to create a capability to open and close the inlet port 218 and the outlet port 220. The inlet port 218 and the outlet port 220 may be strategically located along the coaxial cable system 200 so that once the coaxial cable system 200 is installed/routed on a gas turbine engine, the inlet and outlet ports 218 and 220 are accessible for injecting the dielectric liquid and for maintenance activities. Accordingly, the dielectric fluid may be added, replenished or replaced without removing the coaxial cable system 200 from gas turbine engine and/or significantly dismantling portions of the gas turbine engine to gain access.

The inlet and outlet ports 218 and 220 may also provide monitoring locations, such as for transducers to monitor the pressure, temperature or flow patterns of the dielectric fluid within the closed system of the coaxial cable system 200. Such transducers may wirelessly or by wireline provide electrical signals to a monitoring and/or control system, such as a full authority digital engine control (FADEC) for a gas turbine engine, or other computer system related to control and operation of the gas turbine engine. The monitoring equipment may be permanently or temporarily mounted to the inlet or outlet ports 218 and 220. Accordingly, testing and maintenance activities may be performed on the coaxial cable system 200 using the information collected from such transducers. In other examples, the coaxial cable system 200 may include dedicated ports for use with transducers and other monitoring equipment.

Dielectric liquid injected through the inlet port 218 may flow inside of the flexible conduit 214 into the interstices present in the dielectric tape 210 such that the dielectric tape 210 becomes impregnated with the dielectric liquid. Injection of the dielectric fluid may be at a predetermined elevated pressure and temperature to ensure displacement of air or other fluid from voids within the interstices. The predetermined temperature may decrease the viscosity of the dielectric fluid, and the predetermined pressure may create enough displacement force to remove other fluid from the voids present in the dielectric tape 210, and force such fluid through the exhaust port(s) 220.

The coaxial cable system 200 may also include end seals 224. The end seals 224 may provide fluid tight seals at the first end 204 and the second end 206 providing barriers to the dielectric liquid. The end seals 224 be mechanically coupled with the flexible conduit 214 at an outer periphery of the respective end seals 224. The coupling between the flexible conduit 214 and the respective end seals 224 may be welded, friction fit, snap fit, or any other form of coupling that creates a fluid tight seal between the flexible conduit 214 and the respective end seals 224. In this regard, the end seals 224 may cover openings in the flexible conduit 214 at the first and second ends 204 and 206, or may be mounted within the openings in the flexible conduit 214 at the first and second ends 204 and 206.

Each of the end seals 224 may also include a central open through which the electric conductor 202 may protrude. The electric conductor 202 may extend through the end seals 224 so that the dielectric liquid is contained within a closed system formed between the end seals 224, the electric conductor 202 and the flexible conduit 214. The end seals 224 may create a liquid tight seal surrounding the electric conductor 202. In some examples, the liquid tight seal may be between the central opening of the respective end seals 224 and the dielectric tape 210. In other examples, the liquid tight seal may be between the central opening of the respective end seals 224 and the electric conductor 202. The end seals 224 may be impervious to the temperature and pressure used to inject the dielectric fluid through the inlet port 218 and the operational temperatures and pressures in the environment of the gas turbine engine. The end seals 224 may be installed at any time prior to injection of the dielectric fluid. Accordingly, the coaxial cable system 200 may be installed and/or routed on the gas turbine engine, cut to an appropriate length, the end seals 224 installed, and the electric conductor 202 and any other electric connections terminated.

Figure 3:
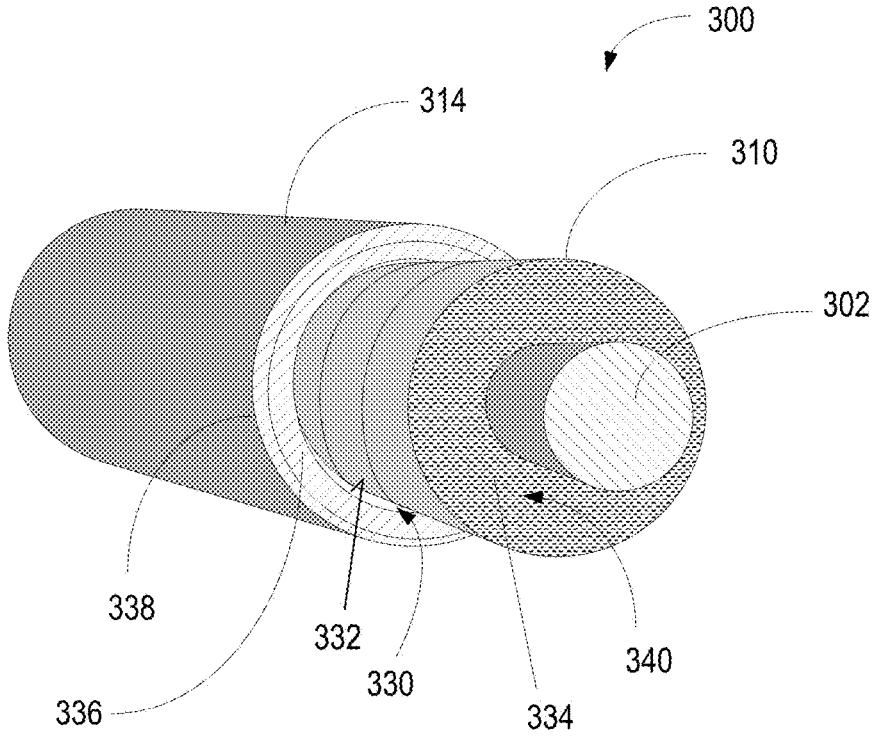
FIG. 3 is a perspective cross-sectional view of an example coaxial cable system.

FIG. 3 is a perspective cross-sectional view of an example coaxial cable system 300. Unless otherwise indicated, the features and functionality of the coaxial cable system 300, the coaxial cable system 200 (FIG. 2) and the coaxial cable system 185 (FIG. 1) are similar. Accordingly, for purposes of brevity the details of these features and functionality will not be repeated, however, it should be understood that such features and functionality are fully interchangeable, combinable, and/or useable in either the coaxial cable system 300, the coaxial cable system 200, and/or the coaxial cable system 185, unless otherwise indicated. In FIG. 3, an electric conductor 202 may be helically wrapped with at least one overlapping dielectric tape 310. The dielectric tape 310 may be a flexible planar insulating material, such as a fabric, fibers or other porous material formed with interstices. Example dielectric tapes include vermiculite coated fiberglass tape, fiberglass tape, ceramic tape, or some combination of these materials.

The dielectric tape 310 may flexibly maintain the position of the electric conductor 302 within a passageway 330 formed by an inner wall 332 of a flexible conduit 314 by being in contiguous contact with the electric conductor 302 and the inner wall 332. The flexible conduit 314 may include an inner sleeve 336 and an outer sleeve 338, both of which are flexible. The inner sleeve 336 may be, for example, corrugated nickel steel providing a neutral or ground current path, and the outer sleeve 338 may be a wire overbraid, such as a stainless steel wire overbraid, providing a protective outer cover concentrically disposed to surround the inner sleeve 336.

The inner sleeve 336 may be hermetically sealed and welded to form the inner wall 332 surrounding the dielectric tape 210 and the electric conductor 302. An interstitial region 340 formed by the dielectric tape 310 between the inner sleeve 336 and the electric conductor 302 may be impregnated or saturated with a dielectric liquid 334. The interstitial region 340 may be formed due to the porous construction of the dielectric tape 310 and the permeable overlapping layers of the dielectric tape 310. In addition, in examples where the inner sleeve 336 is corrugated, the inner wall 332 may include corrugations that add to the interstitial region 340. The dielectric liquid 334 may be statically maintained impregnated in the dielectric tape 310 within the passageway 330 due to the sealed chamber formed between the electric conductor 302 and the flexible conduit 314. The dielectric liquid 334 may cooperatively operate with the dielectric tape 310 to provide continuous electrical insulation between the electric conductor 302, which may conduct electric power, such as high voltage ignition pulses, and the flexible conduit 314. In addition, the dielectric liquid 334 may provide self-healing due to the interconnectivity of voids within the interstitial region 340 and the viscous nature of the dielectric liquid 334. Thus, as the coaxial cable system 300 is bent or flexed, the dielectric liquid 334 may responsively flow within voids included in the interstitial region 340 to maintain the dielectric integrity of the combination of the dielectric tape 310 and the dielectric fluid 334.

The dielectric fluid 334 may also flow along capillary flow paths within the interstitial region 340 in response to localized or regional varying external heating of the flexible conduit 314, or varying internal heating due to current flow in the electrical conductor 302. Such variable heating may change the viscosity of portions of the dielectric liquid 334 to create variable viscosity within the interstitial region 340. Due the varying viscosity, dielectric liquid 334 that is at elevated temperature in localized areas of the interstitial region, such as because of convective heating by the flexible conduit 314 via an external heat source, or heating by the electric conductor 302 due to electric current flow, may flow or move with respect to lower temperature (and therefore less viscous) dielectric liquid 334 included in the interstitial region 340. This thermal based flow or movement of the dielectric liquid due to the varying viscosity, and correspondingly varying internal friction of the dielectric liquid, may result in a more uniform dispersion of heat by the coaxial cable system 300. In addition, in some examples, additional materials, such as nanoparticles may be included/suspended in the dielectric liquid 334 to encourage or enhance the thermal based flow of the dielectric liquid 334 within the interstitial region 340.

In the example coaxial cable system 300 illustrated in FIG. 3, the dielectric tape 310 provides structural support to maintain the electric conductor 302 spaced away from the inner wall 332 throughout the passageway 330. Due to the flexibility of the dielectric tape 310, and the viscosity of the dielectric liquid 334 impregnated in the dielectric tape 310, the insulating barrier provided by the combination remains in place as the flexible conduit is manipulated and bent, such as when the coaxial cable system 300 is installed and routed on a gas turbine engine. In other examples of coaxial cable systems, structural members may be included to maintain the electric conductor 302 spaced away from the inner wall 332. Such structural members may, for example be formed of a rigid material that is wrapped within the overlapping helical coils of the dielectric tape 310. In other examples, such structural members may be intervening structural members positioned in the passageway 330 between the dielectric tape 310 and the inner wall 332. Examples of intervening structural members include a rigid lattice of structural members, a porous rigid material, surrounding rigid structural member containing ducts for dielectric liquid flow, and the like, which may be positioned intermittently or continuously along the length of the electric conductor 302 in the passageway 330.

Figure 4:
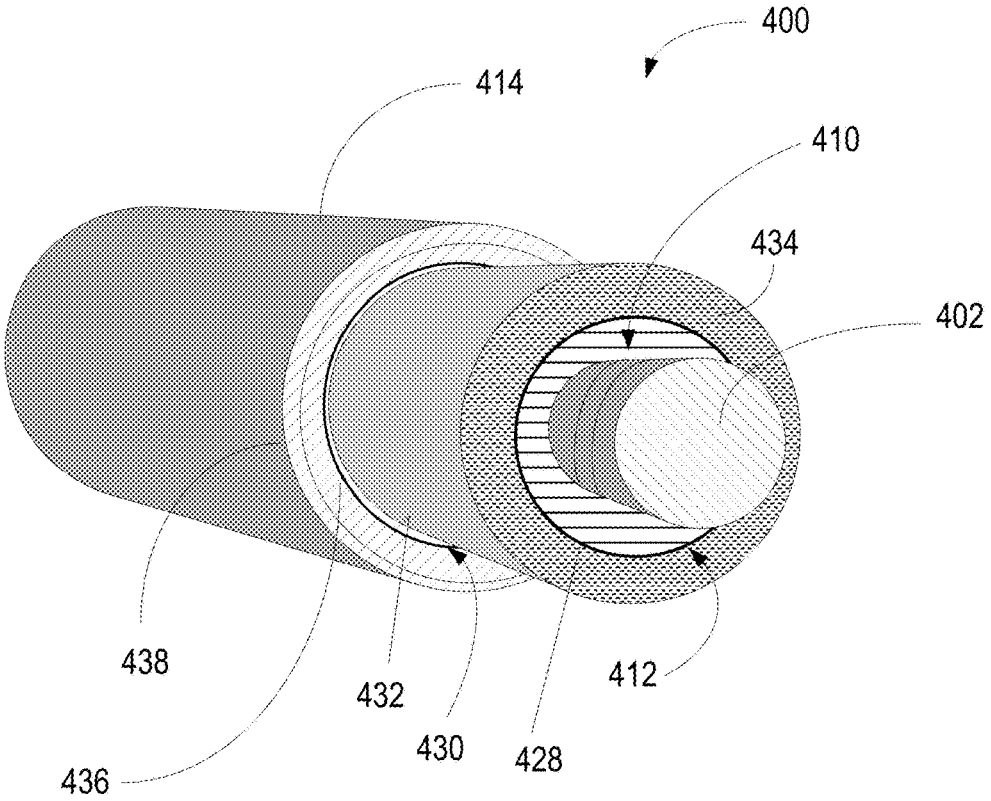
FIG. 4, is a perspective cross-sectional view of another example coaxial cable system.

FIG. 4, is a perspective cross-sectional view of an example coaxial cable system 400. Unless otherwise indicated, the features and functionality of the coaxial cable system 400, the coaxial cable system 300 (FIG. 3), the coaxial cable system 200 (FIG. 2) and the coaxial cable system 185 (FIG. 1) are similar. Accordingly, for purposes of brevity the details of these features and functionality will not be repeated, however, it should be understood that such features and functionality are fully interchangeable, combinable, and/or useable in either the coaxial cable system 400, the coaxial cable system 300, the coaxial cable system 200, and/or the coaxial cable system 185 unless otherwise indicated.

In FIG. 4, the coaxial cable system 400 includes an electric conductor 402 that may be helically wrapped with a dielectric tape 410. The dielectric tape 410 may be a flexible planar insulating material, such as vermiculite coated fiberglass tape, fiberglass tape, ceramic tape, or some combination of these materials. The helically wrapped dielectric tape 410 may include overlapping layers in contiguous contact with a liquid dielectric inner conduit 412. A liquid dielectric outer conduit 414 may surround the liquid dielectric inner conduit 412 and form a cavity 430 therebetween. An outer wall 428 of the liquid dielectric inner conduit 412, an inner wall 432 of the liquid dielectric outer conduit 414 and end seals (not shown) at distal and proximate ends of the coaxial cable system 400 may define the cavity 430. The cavity 430 may provide a closed system that may be filled with a dielectric liquid 434.

The dielectric liquid 434 may act as a heat insulator for the electric conductor 402, and the dielectric tape 410 may act as a flexible electrical insulator and stress relief for the electric conductor 402. Since the dielectric fluid 434 and the dielectric tape 410 are in contiguous contact with opposite sides of the liquid dielectric inner conduit 412, the dielectric liquid 434 and the dielectric tape 410 may cooperatively operate to provide a thermal barrier. When the coaxial cable system 400 is bent and/or routed on a gas turbine engine, the dielectric tape 410 and the fluid 434 may correspondingly move to maintain the insulating and thermal barrier. In the example of FIG. 4, the outer wall 428 of the liquid dielectric inner conduit 412 is impervious to the liquid dielectric 434 and therefore the dielectric tape 410 is separated from the dielectric fluid 434 by the liquid dielectric inner conduit 412.

The liquid dielectric outer conduit 414 may include an inner sleeve 436 and an outer sleeve 438, both of which are flexible. The inner sleeve 436 and the liquid dielectric inner conduit 412 may be, for example, corrugated nickel steel. The inner sleeve 436 may provide a neutral or ground current path, and the outer sleeve 438 may be a wire overbraid, such as a stainless steel wire overbraid, providing a protective outer cover concentrically disposed to surround the inner sleeve 436. The dielectric fluid may be injected into the cavity 430 between the liquid dielectric inner conduit 412 and the inner sleeve 436 using inlet and outlet ports (not shown) positioned to penetrate the outer liquid dielectric conduit 412.

Figure 5:
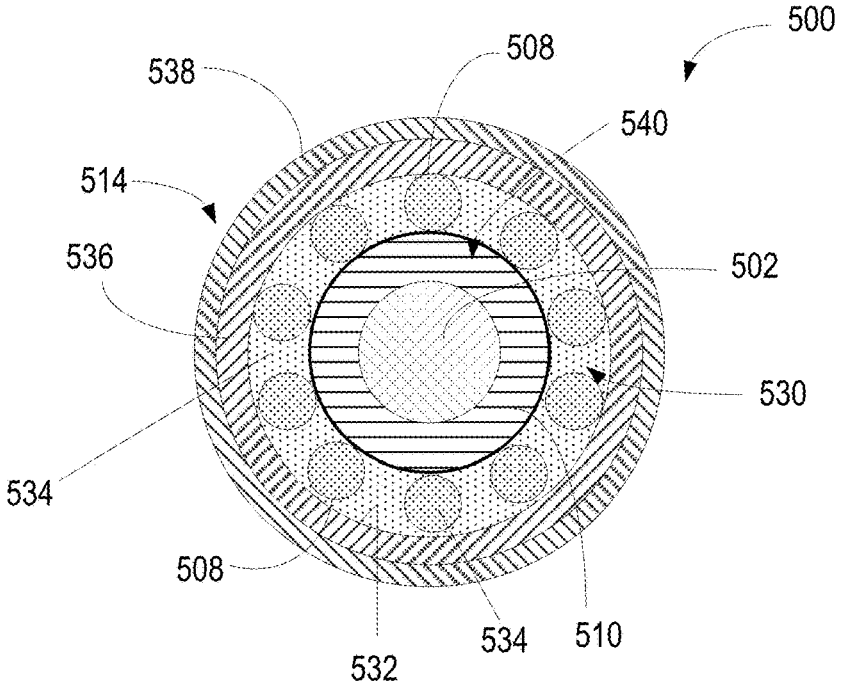
FIG. 5 is a cross-sectional view of another example coaxial cable system.

FIG. 5 is a cross-sectional view of an example coaxial cable system 500. Unless otherwise indicated, the features and functionality of the coaxial cable system 500, the coaxial cable system 400 (FIG. 4), the coaxial cable system 300 (FIG. 3), the coaxial cable system 200 (FIG. 2), and the coaxial cable system 185 are similar. Accordingly, for purposes of brevity the details of these features and functionality will not be repeated, however, it should be understood that such features and functionality are fully interchangeable, combinable, and/or useable in the coaxial cable system 500, the coaxial cable system 400, the coaxial cable system 300, the coaxial cable system 200, and/or the coaxial cable system 185 unless otherwise indicated.

In FIG. 5, the coaxial cable system 500 includes an electric conductor 502 that is helically wrapped with a dielectric tape 510. The dielectric tape 510 may be wrapped in an overlapped configuration to provide an insulating barrier around the electric conductor 502. The dielectric tape 510 may be a flexible planar insulating material, such as a fabric, fibers or other porous material formed with interstices. Example dielectric tapes include vermiculite coated fiberglass tape, fiberglass tape, ceramic tape, or some combination of these materials. Surrounding the dielectric tape 510 may be positioned a plurality of tubes 508. The tubes 508 may be hollow flexible tubes extending along the length of the electric conductor 502 within a flexible conduit 514 positioned to surround the electrical conductor 502 such that the electrical conductor 502, the dielectric tape 510 and the cooling tubes 508 are included in a passageway 530 defined by an inner wall 532 of the flexible conduit 514. The flexible conduit 514 may include an inner sleeve 536 which is hermetically sealed and welded to form the inner wall 532, and an outer sleeve 538, providing a protective outer cover surrounding the inner sleeve 536. The inner wall 532 may be impervious to dielectric liquid.

The tubes 508 may be maintained in axial and circumferentially spaced position in the passageway 530 by being in contiguous contact with the dielectric tape 510 and the inner wall 532 with liquid dielectric 534 disposed between adjacently positioned cooling tubes 508. The liquid dielectric 534 may also be impregnated in voids in interstitial areas 540 within the porous and overlapping dielectric tape 510. In addition, the liquid dielectric 534 may be present in the tubes 508. Thus, the liquid dielectric 534 may be a thermal barrier in the porous and overlapping dielectric tape 510 and the area of the passageway 530 between the dielectric tape 510 and the inner wall 532 in which the tubes 508 are positioned. The tubes 508 may include ports to allow fluid communication between the dielectric fluid 534 in the tubes 508 and the dielectric fluid in passageway 530.

The dielectric liquid 534 may be statically maintained impregnated in the dielectric tape 510, within the passageway 530, and in the tubes 508 due to the sealed chamber formed between the electric conductor 502 and the flexible conduit 514. The dielectric liquid 534 in the interstitial region 540 may cooperatively operate with the dielectric tape 510 to provide continuous electrical insulation between the electric conductor 502, which may conduct electric power, such as high voltage ignition pulses, and the tubes 508 and flexible conduit 514. In addition, the dielectric liquid 534 within the interstitial region 540 may provide self-healing due to the interconnectivity of voids within the interstitial region 540 and the viscous nature of the dielectric liquid 534. Thus, as the coaxial cable system 500 is bent or flexed, the dielectric liquid 534 may responsively flow within voids included in the interstitial region 540 to maintain the insulating integrity of the combination of the dielectric tape 510 and the dielectric fluid 534. The dielectric fluid may also flow in the presence of variable temperature along the coaxial cable system 500.

In another example, the tubes 508 may be separated from the dielectric tape 510 by an inner fluid conduit that is impervious to dielectric liquid, as discussed with reference to the example of FIG. 4. In this example configuration, the tubes 508 and the passageway 530 are in the closed system of the dielectric fluid 534, however, the dielectric tape 510 is omitted from the closed system. Thus, the dielectric fluid in the tubes 508 and passageway 530 and the dielectric tape 510 cooperatively operate to provide a thermal barrier, whereas the dielectric tape 510 provides an insulating barrier around the electric conductor 502.

In still other example configurations, dielectric fluid may be present in the interstitial region 540 of the dielectric tape 510 as a first static dielectric fluid reservoir and in the tubes 508 and passageway 530 as a second dielectric fluid reservoir. In this example configuration, the inner fluid conduit may maintain fluid separation between the first and second dielectric liquid reservoirs such that the dielectric fluid in both reservoirs cooperatively operates to provide a thermal barrier and the dielectric liquid in the interstitial region 540 cooperatively operates with the dielectric tape to provide both an insulating barrier and a thermal barrier. Also in this example configuration, dielectric liquid may be injected into and discharged for the first dielectric reservoir via the input and output ports on the flexible conduit 514, and for the second dielectric reservoir via ports in the tubes 508.

The coaxial cable system 500 may also include end seals (not shown) to provide fluid tight seals at the proximate and distal ends of the flexible conduit 514. The end seals may be mechanically coupled with the flexible conduit 514 to form a static chamber defined by end seals, the inner wall 532, and the electric conductor 502. Each of the end seals may also include a central open through which the electric conductor 502, the dielectric tape 510 and the tubes 508 may protrude so that the dielectric liquid 534 is contained within a closed system formed between the end seals, the electric conductor 502 and the flexible conduit 514. The end seals may create a liquid tight seal surrounding the electric conductor 502, the dielectric tape 510 and the tubes 508. The end seals may be impervious to the temperature and pressure used to inject the dielectric liquid 534. Injection of the dielectric liquid 534 into the coaxial conduit system 500 may occur through tubes 508 once the end seals are installed. Alternatively, input and output ports (not shown) may be included on the flexible conduit 514, as discussed elsewhere.

Figure 6:
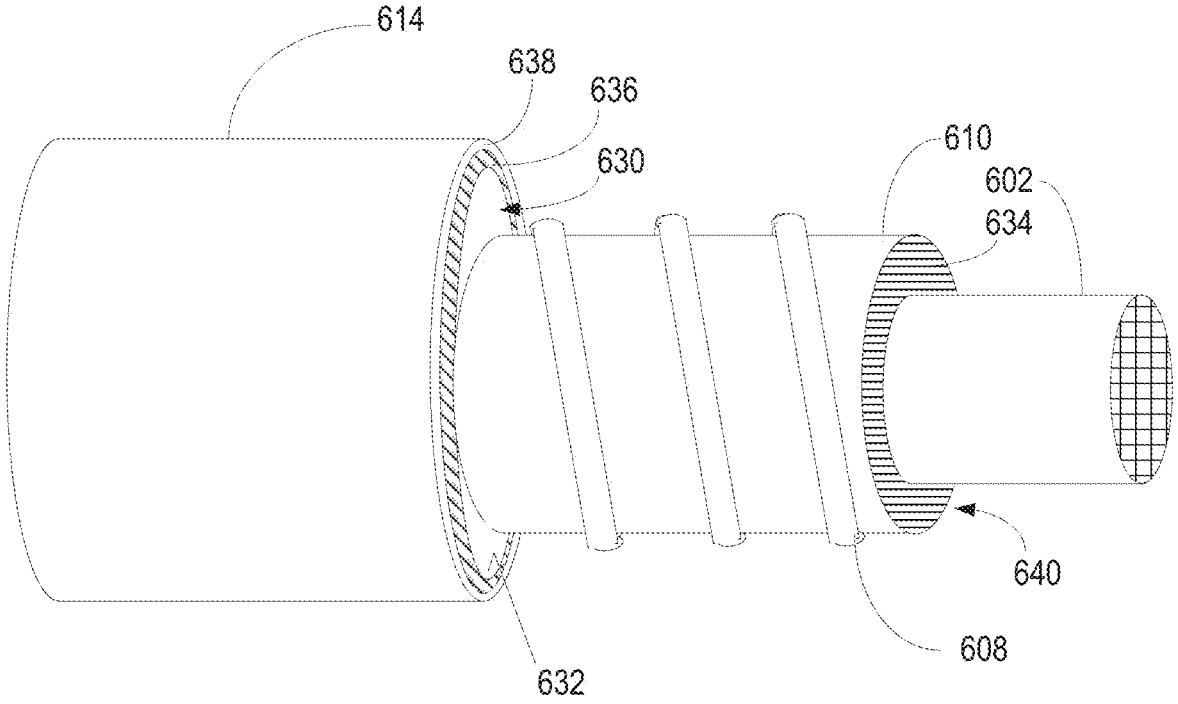
FIG. 6 is a perspective view of another example coaxial cable system.

FIG. 6 is a perspective view of an example coaxial cable system 600. Unless otherwise indicated, the features and functionality of the coaxial cable system 600, the coaxial cable system 500, the coaxial cable system 400 (FIG. 4), the coaxial cable system 300 (FIG. 3), the coaxial cable system 200 (FIG. 2), and the coaxial cable system 185 are similar. Accordingly, for purposes of brevity the details of these features and functionality will not be repeated, however, it should be understood that such features and functionality are fully interchangeable, combinable, and/or useable in the coaxial cable system 600, the coaxial cable system 500, the coaxial cable system 400, the coaxial cable system 300, the coaxial cable system 200, and/or the coaxial cable system 185 unless otherwise indicated.

In FIG. 6 portions of the coaxial cable system 600 have been omitted for illustrative purposes to illustrate a helical configuration of tubes 608 surrounding and contiguously contacting dielectric tape 610. The dielectric tape 610 is a porous material that is helically wrapped in an overlapping configuration around a conductor 602. A flexible outer conduit 614 includes an inner sleeve 636 forming an inner wall 632 that defines a passageway 630 in which the tube 608, dielectric tape 610 and electric conductor 602 are disposed. The flexible outer conduit 614 also includes an outer sleeve 638 providing a protective outer cover for the coaxial cable system 600.

Similar to the examples discussed with reference to FIG. 5, the tube 608 may include ports to provide liquid communication between dielectric liquid 634 included in the tube 608, the passageway 630 and the dielectric fluid impregnated in the dielectric tape 610 in the interstitial region 640, which is formed in the porous dielectric tape 610 and voids created by the helical overlap of the dielectric tape 610. In addition, the helical winding formed by the tube 608 may penetrate the end seals at the distal and proximate ends of the coaxial cable system 600 to provide the capability to inject the dielectric liquid and discharge fluid from the closed system. In other examples, the coaxial cable system 600 may include an inner fluid conduit that separates the dielectric tape 610 from the helical tube 608. In these examples, the dielectric fluid may be absent from the interstitial region 640 but be in the closed system formed by the passageway 630, tubes 508 and end seals, or the first and second dielectric fluid reservoirs may be present, as discussed with reference to FIG. 5.

The coaxial cable system described herein may improve the capability of power transmission in gas turbine engine system, such as transmission of ignition impulses in a combustor ignition system. In a combustor ignition system, the coaxial cable system may be used as an ignition lead assembly due to its insulating and temperature capabilities that allow high voltage power transfer and routing of the coaxial cable system in high temperature areas around the combustors of the gas turbine engine which would not be possible with PTFE based insulation. The high temperature and high voltage capabilities in this flexible design allows variable routing on the gas turbine engine due at least in part to the high temperature taped insulation and liquid dielectric insulation features of the coaxial cable system. An example of an insulation scheme of the coaxial cable system may include the use of Vermiculite or high temperature ceramic insulating tapes, which may be used in conjunction with a liquid dielectric such as Krytox™. The coaxial cable system may use a combination of high temperature, taped insulation fabricated from either mineral, glass and/or ceramic based high temperature tapes which may provide solid, but porous insulating tapes and dielectric liquid for insulation of a high voltage electric conductor from other conductors, such as an outer ground shell which may be included in the coaxial cable system. The liquid dielectric may fill interstitial regions between permeable layers of the dielectric tape to provide a self-healing capability for areas with localized high electric fields, due to the viscosity of the dielectric liquid enabling flow within the coaxial cable system.

In addition to being a high quality dielectric, the dielectric liquid may also be a fire resistant fluid, which may address environmental challenges related to gas turbine engines, such as challenges related to installation and routing requirements for an ignition system of a gas turbine engine. With the coaxial cable system, the outer conductor (flexible conduit) and the inner conductor (electric conductor) may be metallic, and the high temperature insulating tapes and oil based insulation may be made with non-flammable materials to accommodate high temperature areas. Manufacture of the coaxial cable system may accomplished with planetary winding and welding techniques since the flexible conduit, which may provide a metallic shield, may be a hermetically sealed and welded assembly formed around the electric conductor. The coaxial cable system may also include ceramic to metal end seals, which may be positioned at each end of the system, and some form of fill port to inject the dielectric liquid.

To clarify the use of and to hereby provide notice to the public, the phrases "at least one of <A>, <B>, . . . and <N>" or "at least one of <A>, <B>, <N>, or combinations thereof" or "<A>, <B>, . . . and/or <N>" are defined by the Applicant in the broadest sense, superseding any other implied definitions hereinbefore or hereinafter unless expressly asserted by the Applicant to the contrary, to mean one or more elements selected from the group comprising A, B, . . . and N. In other words, the phrases mean any combination of one or more of the elements A, B, . . . or N including any one element alone or the one element in combination with one or more of the other elements which may also include, in combination, additional elements not listed. Unless otherwise indicated or the context suggests otherwise, as used herein, "a" or "an" means "at least one" or "one or more."

The subject-matter of the disclosure may also relate, among others, to the following aspects:

1. A coaxial cable system comprising:

an electric conductor to conduct electric power in a gas turbine engine;

a dielectric tape helically wound to contiguously surround the electric conductor;

a flexible conduit disposed to surround and contiguously contact the dielectric tape;

a dielectric liquid impregnated within the dielectric tape; and a flexible protective cover concentrically disposed to surround the flexible conduit.

2. The system of aspect 1, wherein the dielectric tape include interstices, and the dielectric liquid is disposed in the interstices and voids formed by overlapping layers of the helically wound dielectric tape after the electric conductor is helically wrapped, wherein the flexible conduit is impervious to the dielectric fluid.

3. The system of aspect 2, wherein the dielectric tape is a flexible tape that comprises ceramic, fiberglass, vermiculate or a combination thereof.

4. The system as in any of aspects 1-3, further comprising a seal at a distal end and a proximate end of the flexible conduit, the seal providing a barrier to the dielectric liquid, and the electrical conductor extending through the seal so that the dielectric liquid is contained within a closed system formed between the seals, the electric conductor and the flexible conduit.

5. The system as in any of aspect 1-4, further comprising an inlet at a proximate end of the flexible conduit to receive the dielectric liquid and an outlet at a distal end of the flexible conduit, the inlet and the outlet providing liquid communication between the dielectric tape and an external environment, and each of the inlet and the outlet including a removal seal operable as a barrier to the dielectric liquid.

6. The system as in any of aspects 1-5, wherein the dielectric tape is constructed and/or helically wound to provide a capillary flow path for the dielectric liquid so that the dielectric liquid can flow along the capillary flow path in response to temperature variations along the flexible conduit.

7. The system as in any of aspects 1-6, wherein at least portions of the dielectric tape are in contiguous contact with an interior wall of the flexible conduit to maintain a position of the electric conductor in the flexible conduit, and the flexible conduit is impervious to the dielectric liquid.

8. The system as in any of aspects 1-7, wherein the dielectric tape and the dielectric liquid are contained in a sealed chamber formed between the electric conductor and the flexible conduit.

9. The system as in any of aspects 1-8, wherein the electric conductor is routed and terminated in the gas turbine engine to conduct high voltage ignition pulses to an ignitor included in the gas turbine engine.

10. A method comprising:

helically wrapping an electric conductor with a dielectric tape, the electric conductor to supply electric power in a gas turbine engine;

positioning the helically wrapped electric conductor in a flexible conduit;

positioning the flexible conduit containing the helically wrapped conductor in a flexible protective outer cover;

routing the flexible conduit positioned in the flexible protective cover and containing the helically wrapped conductor on the gas turbine engine;

injecting a dielectric liquid into the flexible conduit via an inlet port included at a proximate end of the flexible protective outer cover;

impregnating the dielectric tape with the dielectric liquid being injected;

discharging fluid from the flexible conduit by injection of the dielectric liquid, the fluid discharged via an outlet port included at a distal end of the flexible conduit; and sealing the inlet port and the outlet port in response to discharge of the dielectric liquid from the outlet port.

11. The method of aspect 10, further comprising positioning at least a portion of the flexible conduit proximate a combustor of the gas turbine engine, and electrically connecting the electric conductor to an ignitor included in the combustor.

12. The method of aspect 11, further comprising circulating the dielectric fluid within the dielectric tape by convection of heat produced from the combustor.

13. The method as in any of aspects 10-12, further comprising inserting spacers within the helically wrapped dielectric tape to create channels to contain and flow the dielectric liquid impregnated in the dielectric tape by convection in response to variable heat along the flexible conduit.

14. The method as in any of aspects 10-13, further comprising including a spacer around the dielectric tape or within the dielectric tape to create channels to contain and flow the dielectric liquid impregnated in the dielectric tape by convection in response to variable heat along the flexible conduit.

15. The method as in any of aspects 10-14, further comprising:

sealing openings in the flexible conduit with end seals at the proximate end and the distal end to create a closed system to contain the dielectric liquid impregnated in dielectric tape; and extending the electric conductor and the dielectric tape through the end seals external to the flexible conduit.

16. A system comprising:

an electric conductor providing electric power in a gas turbine engine, the electrical conductor helically wrapped with a dielectric tape and disposed in a flexible conduit;

the electric conductor maintained in position within the flexible conduit by the dielectric tape contiguously contacting an interior wall of the flexible conduit;

the flexible conduit comprising an inner sleeve and an outer sleeve; and a dielectric fluid included in a tube positioned in contiguous contact with the inner sleeve and between the inner sleeve and the outer sleeve.

17. The system of aspect 16, wherein the tube is formed as a helical coil around the inner sleeve.

18. The system of aspect 16 or 17, wherein the tube is formed as a plurality of tubes in liquid communication with the dielectric liquid, and axially positioned in the inner sleeve to extend along the electric conductor.

19. The system as in any of aspects 16-18, wherein the tube that includes the dielectric liquid is included in a closed static system formed by an inner wall of the flexible conduit.

20. The system as in any of aspects 16-19, wherein the electric conductor is electrically coupled with an ignitor for a combustor of the gas turbine engine.

While various embodiments have been described, it will be apparent to those of ordinary skill in the art that many more embodiments and implementations are possible. Accordingly, the embodiments described herein are examples, not the only possible embodiments and implementations.

What is claimed is:

1. A coaxial cable system comprising:

an electric conductor to conduct electric power in a gas turbine engine;

a dielectric tape helically wound to contiguously surround the electric conductor;

a flexible conduit disposed to surround the dielectric tape;

a dielectric liquid impregnated within the dielectric tape, wherein the dielectric tape is constructed and/or helically wound to provide a capillary flow path for the dielectric liquid so that the dielectric liquid can flow along the capillary flow path in response to temperature variations along the flexible conduit; and a flexible protective cover concentrically disposed to surround the flexible conduit;

an inlet at a proximate end of the flexible conduit to receive the dielectric liquid and an outlet at a distal end of the flexible conduit, the inlet and the outlet providing liquid communication along the electric conductor between the dielectric tape and an external environment, the inlet and the outlet positionable on the gas turbine engine such that dielectric liquid injectable into the inlet flows along the electric conductor toward the outlet via the capillary flow path to saturate the dielectric tape, each of the inlet and the outlet including a removable seal operable as a barrier to statically maintain the dielectric liquid within the flexible conduit;

a tube positioned in the flexible conduit between the electric conductor helically wrapped with the dielectric tape and an interior wall of the flexible conduit, the tube being a hollow flexible cooling tube; and a liquid dielectric inner conduit between the tube and the electric conductor helically wrapped with the dielectric tape, the liquid dielectric inner conduit being impervious to dielectric liquid and surrounding the electric conductor helically wrapped with the dielectric tape, wherein the tube that includes the dielectric liquid is included in a first closed static fluid reservoir formed between the liquid dielectric inner conduit and the interior wall of the flexible conduit, and the capillary flow path along the electric conductor helically wrapped with the dielectric tape is included in a second static fluid reservoir.

2. The system of claim 1, wherein the dielectric tape includes interstices, and the dielectric liquid injectable into the inlet is disposed in the interstices and voids formed by overlapping layers of the helically wound dielectric tape after the electric conductor is helically wrapped with the dielectric tape, wherein the flexible conduit is impervious to the dielectric liquid.

3. The system of claim 2, wherein the dielectric tape is a flexible tape that comprises ceramic, fiberglass, vermiculate or a combination thereof.

4. The system of claim 1, further comprising a seal at the distal end and the proximate end of the flexible conduit, the seal providing a barrier to the dielectric liquid, and the electrical conductor extending through the seal so that the dielectric liquid is contained within a closed system formed between the seals, the electric conductor and the flexible conduit.

5. The system of claim 1, wherein the flexible conduit is impervious to the dielectric liquid.

6. The system of claim 1, wherein the dielectric tape and the dielectric liquid are contained in a sealed chamber formed between the electric conductor and the flexible conduit.

7. The system of claim 1, wherein the electric conductor is routed and terminated in the gas turbine engine to conduct high voltage ignition pulses to an ignitor included in the gas turbine engine.

8. A method comprising:

helically wrapping an electric conductor with a dielectric tape, the electric conductor to supply electric power in a gas turbine engine;

inserting the electric conductor helically wrapped with the dielectric tape in a liquid dielectric inner conduit, the liquid dielectric inner conduit being impervious to dielectric liquid and surrounding the electric conductor helically wrapped with the dielectric tape;

inserting the liquid dielectric inner conduit containing the electric conductor helically wrapped with the dielectric tape in a tube, the tube being a hollow flexible cooling tube;

positioning the tube in a flexible conduit, the tube positioned in the flexible conduit between the electric conductor helically wrapped with the dielectric tape and an interior wall of the flexible conduit;

positioning the flexible conduit containing the helically wrapped conductor in a flexible protective outer cover;

routing the flexible conduit positioned in the flexible protective cover and containing the helically wrapped conductor on the gas turbine engine;

injecting dielectric liquid into the flexible conduit via an inlet port included at a proximate end of the flexible protective outer cover;

flowing the dielectric liquid along the electric conductor via a capillary flow path provided by the helically wound dielectric tape, the dielectric tape constructed and helically wound to provide the capillary flow path for the dielectric liquid so that the injected dielectric liquid flows along the capillary flow path;

impregnating the dielectric tape with the dielectric liquid being injected to saturate the dielectric tape with the dielectric liquid;

discharging fluid from the flexible conduit by injection of the dielectric liquid, the fluid discharged via an outlet port included at a distal end of the flexible conduit; and sealing the inlet port and the outlet port in response to discharge of the dielectric liquid from the outlet port to statically maintain the dielectric liquid in the flexible conduit so that the dielectric liquid flows via the capillary flow path only within the flexible conduit in response to temperature variations along the flexible conduit.

9. The method of claim 8, further comprising positioning at least a portion of the flexible conduit proximate a combustor of the gas turbine engine, and electrically connecting the electric conductor to an ignitor included in the combustor.

10. The method of claim 9, further comprising circulating the dielectric fluid within the dielectric tape by convection of heat produced from the combustor.

11. The method of claim 8, further comprising inserting spacers within the helically wrapped dielectric tape to create channels to contain and flow the dielectric liquid impregnated in the dielectric tape by convection in response to variable heat along the flexible conduit.

12. The method of claim 8, further comprising including a spacer around the dielectric tape or within the dielectric tape to create channels to contain and flow the dielectric liquid impregnated in the dielectric tape by convection in response to variable heat along the flexible conduit.

13. The method of claim 8, further comprising:

sealing openings in the flexible conduit with end seals at the proximate end and the distal end to create a closed system to contain the dielectric liquid impregnated in dielectric tape; and extending the electric conductor and the dielectric tape through the end seals external to the flexible conduit.

14. A system comprising:

an electric conductor providing electric power in a gas turbine engine, the electrical conductor helically wrapped with a dielectric tape and disposed in a flexible conduit;

the electric conductor maintained in position within the flexible conduit by an interior wall of the flexible conduit;

the flexible conduit comprising an inlet and an outlet positioned on the flexible conduit for accessibility after the flexible conduit is installed on the gas turbine engine, the inlet configured to receive dielectric liquid and the dielectric tape providing a capillary flow path along the electric conductor toward the outlet to saturate the dielectric tape helically wrapped on the electric conductor;

an inlet seal disposed on the inlet, and an outlet seal disposed on the outlet to statically maintain the dielectric liquid in the flexible conduit such that the dielectric liquid flows via the capillary flow path only within the flexible conduit in response to temperature variations along the flexible conduit;

a tube positioned in the flexible conduit between the electric conductor helically wrapped with the dielectric tape and the interior wall, the tube being a hollow flexible cooling tube; and a liquid dielectric inner conduit between the tube and the electric conductor helically wrapped with the dielectric tape, the liquid dielectric inner conduit being impervious to dielectric liquid and surrounding the electric conductor helically wrapped with the dielectric tape, wherein the tube that includes the dielectric liquid is included in a first closed static fluid reservoir formed between the liquid dielectric inner conduit and the interior wall of the flexible conduit, and the capillary flow path along the electric conductor helically wrapped with the dielectric tape is included in a second static fluid reservoir.

15. The system of claim 14, wherein the tube is formed as a helical coil around the electric conductor helically wrapped with the dielectric tape.

16. The system of claim 14, wherein the tube is formed as a plurality of tubes in liquid communication with the dielectric liquid, and axially positioned between the electric conductor helically wrapped with the dielectric tape and the interior wall to extend along the electric conductor.

17. The system of claim 14, wherein the first closed static fluid reservoir and the second closed static fluid reservoir are in liquid communication with the inlet port and the outlet port.

18. The system of claim 14, wherein the electric conductor is electrically coupled with an ignitor for a combustor of the gas turbine engine, and the inlet and outlet are positioned on the flexible conduit to reside outside and proximate the combustor of the gas turbine engine.

* * * * *